US008267264B2

(12) United States Patent
Bryfors et al.

(10) Patent No.: US 8,267,264 B2
(45) Date of Patent: Sep. 18, 2012

(54) CALIBRATION DEVICE, METHOD AND SYSTEM FOR A CONTAINER CRANE

(75) Inventors: Uno Bryfors, Vasteras (SE); Bjorn Henriksson, Västerås (SE); Erik Lindeberg, Nyköping (SE); Eric Strale, Vasteras (SE); Martin Aberg, Stockholm (SE); Christer Johansson, Vasteras (SE)

(73) Assignee: ABB AB (SE)

( * ) Notice: Subject to any disclaimer, the term of this patent is extended or adjusted under 35 U.S.C. 154(b) by 631 days.

(21) Appl. No.: 12/487,276

(22) Filed: Jun. 18, 2009

(65) Prior Publication Data

US 2009/0326718 A1 Dec. 31, 2009

Related U.S. Application Data

(63) Continuation of application No. PCT/EP2007/064469, filed on Dec. 21, 2007.

(30) Foreign Application Priority Data

Dec. 21, 2006 (SE) ..... 0602790

(51) Int. Cl.
*B66C 13/46* (2006.01)

(52) U.S. Cl. ..... 212/274; 212/270; 212/276; 356/139.1; 356/614

(58) Field of Classification Search ..... 212/270, 212/274, 276; 356/139.1, 614
See application file for complete search history.

(56) References Cited

U.S. PATENT DOCUMENTS 4,281,342 A * 7/1981 Ueda et al. ..... 348/94
4,784,420 A * 11/1988 Makino et al. ..... 294/81.4
5,491,549 A * 2/1996 Wichner et al. ..... 356/141.2
5,878,896 A * 3/1999 Eudier et al. ..... 212/270
6,124,932 A * 9/2000 Tax et al. ..... 356/614
6,145,680 A * 11/2000 Jussila et al. ..... 212/274
6,182,843 B1 * 2/2001 Tax et al. ..... 212/274
6,229,473 B1 * 5/2001 Doemens et al. ..... 342/59

(Continued)

FOREIGN PATENT DOCUMENTS

EP 1043262 A1 10/2000

(Continued)

OTHER PUBLICATIONS

International Preliminary Report on Patentability and Written Opinion of the International Searching Authority; PCT/EP2007/064469; Jun. 24, 2009; 6 pages.

(Continued)

*Primary Examiner* — Emmanuel M Marcelo
(74) *Attorney, Agent, or Firm* — St. Onge Steward Johnston & Reens LLC

(57) ABSTRACT

A device, method and system for automatic calibration of a container crane, the container crane being controlled by a system including a first sensor (LPS) and/or a second sensor (TPS), are provided. A calibration rig is arranged in a fixed position and includes a plurality of markers, each arranged at a known and fixed position and distance relative to one another. The markers may include a first marker with a first visual appearance, or active marker and/or a second marker with a second visual appearance, or passive marker. The active marker is preferably an illumination source, such as an IR source. A method for calibrating a container crane using the calibration device and a container control system including the calibration device and one or more computer programs are also described.

18 Claims, 6 Drawing Sheets

U.S. PATENT DOCUMENTS

| | | | | |
|---|---|---|---|---|
| 6,234,332 | B1 * | 5/2001 | Monzen et al. | 212/275 |
| 6,256,553 | B1 * | 7/2001 | Erikkila | 700/213 |
| 6,351,720 | B1 * | 2/2002 | Hoshina et al. | 702/154 |
| 6,505,998 | B1 * | 1/2003 | Bullivant | 405/271 |
| 7,040,496 | B2 * | 5/2006 | Hakala | 212/274 |
| 7,123,132 | B2 * | 10/2006 | Heidenback et al. | 340/431 |
| 7,137,771 | B2 * | 11/2006 | Maurer et al. | 414/334 |
| 7,331,477 | B2 * | 2/2008 | Schulte et al. | 212/270 |
| 7,950,539 | B2 * | 5/2011 | Henriksson | 212/274 |
| 2002/0024598 | A1 * | 2/2002 | Kunimitsu et al. | 348/159 |
| 2002/0191813 | A1 | 12/2002 | Uchida et al. | |
| 2004/0026349 | A1 * | 2/2004 | Colgate et al. | 212/284 |
| 2005/0016005 | A1 * | 1/2005 | Voecks | 33/344 |
| 2005/0192702 | A1 | 9/2005 | Moutsokapas | |
| 2005/0232626 | A1 | 10/2005 | Schulte et al. | |
| 2005/0281644 | A1 * | 12/2005 | Lussen et al. | 414/403 |

FOREIGN PATENT DOCUMENTS

| | | | |
|---|---|---|---|
| EP | 1894881 | A2 | 3/2008 |
| JP | 2006312521 | A | 11/2006 |
| WO | 9114644 | A1 | 10/1991 |
| WO | 0023347 | A1 | 4/2000 |
| WO | 2007000256 | A1 | 1/2007 |

OTHER PUBLICATIONS

International Search Report; PCT/EP2007/064469; Mar. 20, 2008; 2 pages.

International Search Report; ITS/SE06/00622; Jun. 15, 2007; 3 pages.

* cited by examiner

CALIBRATION DEVICE, METHOD AND SYSTEM FOR A CONTAINER CRANE

CROSS-REFERENCE TO RELATED APPLICATIONS

The present application is a continuation of pending International patent application PCT/EP2007/064469 filed on Dec. 21, 2007 which designates the United States and claims priority from Swedish patent application 0602790-8 filed on Dec. 21, 2006 the content of which is incorporated herein by reference.

FIELD OF THE INVENTION

The invention relates to a device for automatic calibration of a container crane and a method for carrying out such an automatic calibration. The method may involve automatic and/or manual procedures.

BACKGROUND OF THE INVENTION

Container cranes are used to handle freight containers and especially to transfer containers between transport modes at container terminals, freight harbours and the like. Standard shipping containers are used to transport a great and growing volume of freight around the world. Transshipment is a critical function in freight handling. Transshipment may occur at each point of transfer and there is usually a tremendous number of containers that must be unloaded, transferred to a temporary stack, and later loaded on to another ship, back onto the same ship or loaded instead onto another form of transport. Loading and unloading containers to and from a ship takes a great deal of time. The development of automated cranes has improved loading and unloading and made the productivity more predictable, and also eliminated many situations in which port workers have been exposed to danger and injury.

For accurate handling of containers the control systems that regulate the picking up and landing of containers must be calibrated. This may comprise calibrating sub systems of the crane control systems. For example on gantry cranes or ship-to-shore cranes (STS) that run on rails, a somewhat random error that may occur is caused by changes in one or more wheel positions on a gantry rail, which may cause a skew error. Other errors may arise from subsidence in or damage to the area the containers stand upon, so that the position of a landing slot for a container may change. In addition, when optical sensor equipment or position encoder sensors are repaired or moved a re-calibration is necessary.

It is estimated that with today's manual procedures it may take about 4-8 hours per crane to perform a LPS (Load Position Sensor), TPS (Target Position Sensor) and co-calibration. A LPS subsystem finds the position of the load (container or empty spreader) during lifting, handling, and a TPS subsystem finds the position of a target landing place on a ground slot or on a vehicle, as well as mapping positions of other containers, container stacks etc in the vicinity of a target. In addition, depending on how much time is available, an estimated 1-4 hours may be spent on stacking tests and parameter fine-tuning. These are average estimates for a block of containers, which is a given stacking area of eg between two adjacent cranes, when the block has been emptied and taken out of production. If calibration is to be performed on a crane in a block that is in production it often takes more time than that because the procedure is interrupted and has to start over several times. In addition it is often not allowed, on safety grounds, for a maintenance person to work alone in a block of containers.

The error in measurement may come from any of many sources such as: inclination in gantry rail; curves in gantry rail causing skew in crane position; wheel position on gantry rail causing offsets in trolley direction; wheel position on gantry rail causing skew in crane position; gantry positioning error (synchronization offset); twisted trolley girder profile causing error in measurement angle; skew of trolley platform on trolley rail; LPS system calibration error; TPS system calibration error.

Some errors such as TPS system calibration error tend to be constant through a given block of containers. Other errors such as gantry rail inclination and direction depend on gantry position and may thus differ from bay to bay within a given block. Error in gantry inclination also twists the trolley girder, which makes the error different from one row of containers to another in the same block.

SUMMARY OF THE INVENTION

The aim of the present invention is to provide an improved device, method and system for automatic calibration of the lifting and handling systems of a container crane.

This and other aims are obtained by a method, and a system characterised by the attached independent claims. Advantageous embodiments are described in sub-claims to the above independent claims.

In a first aspect of the invention a calibration device for automatic calibration of a container crane is described, wherein said container crane is controlled by a system comprising at least a first sensor and a second sensor, the device further comprising a calibration rig arranged in a fixed position and comprising a plurality of markers each arranged at a known and fixed position and distance relative to one another.

In an embodiment of the invention a calibration device for automatic calibration of a container crane is described, said device comprising at least a first sensor and a second sensor, and a calibration rig arranged in a fixed position and comprising a plurality of markers each arranged at a known and fixed position and distance relative to one another wherein the calibration rig is arranged in a fixed position in a container yard, freight yard or harbour.

In an embodiment of the invention a calibration device for automatic calibration of a container crane is described, said device comprising at least a first sensor and/or a second sensor, and a calibration rig arranged in a fixed position and comprising a plurality of markers each arranged at a known and fixed position and distance relative to one another wherein the calibration rig is arranged with at least two 2 first markers comprising a surface with a first visual appearance.

In another embodiment of the invention a calibration device for automatic calibration of a container crane is described, said device comprising at least a first sensor and/or a second sensor, and a calibration rig arranged in a fixed position and comprising a plurality of markers each arranged at a known and fixed position and distance relative to one another wherein the at least two first markers with the first visual appearance are active markers.

In another embodiment of the invention a calibration device for automatic calibration of a container crane is described, said device comprising at least a first sensor and/or a second sensor, and a calibration rig arranged in a fixed position and comprising a plurality of markers each arranged at a known and fixed position and distance relative to one another wherein the calibration rig is arranged with at least two second markers comprising a surface with a second visual appearance.

In another embodiment of the invention a calibration device for automatic calibration of a container crane is described, said device comprising at least a first sensor and/or a second sensor, and a calibration rig arranged in a fixed position and comprising a plurality of markers each arranged at a known and fixed position and distance relative to one another wherein the at least two second markers with the second visual appearance are passive markers.

In an embodiment of the invention a calibration device for automatic calibration of a container crane is described, said device comprising a calibration rig arranged in a fixed position a plurality of markers each arranged at a known and fixed position and distance relative to one another wherein at least two first or active markers comprise an illumination source from any of the group of: IR laser, IR lamp, visible spectra lamp.

In an embodiment of the invention a calibration device for automatic calibration of a container crane is described, said device comprising a calibration rig arranged in a fixed position a plurality of markers each arranged at a known and fixed position and distance relative to one another wherein at least two second or passive markers comprise a substantially planar part bounded by at least one straight edge each arranged at the arranged at a known and fixed position.

In an embodiment of the invention a calibration device for automatic calibration of a container crane is described, said device comprising a calibration rig arranged in a fixed position a plurality of markers each arranged at a known and fixed position and distance relative to one another wherein the least two first or active markers are each arranged attached to a passive marker.

In another embodiment of the invention a calibration device for automatic calibration of a container crane is described, said device comprising a calibration rig arranged in a fixed position a plurality of markers each arranged at a known and fixed position and distance relative to one another wherein at least two first or active markers are arranged in the same known and substantially horizontal plane and separated by a known distance and a third first or active marker is arranged substantially vertically above the first two active markers and separated by a known vertical distance.

In an embodiment of the invention a calibration device for automatic calibration of a container crane is described, wherein said container crane is controlled by a system comprising at least a first sensor and/or a second sensor, the device further comprising a calibration rig arranged in a fixed position and comprising a plurality of markers each arranged at a known and fixed position and distance relative to one another and wherein at least first sensor is part of a load position system of the container crane and said second sensor is part of a target position system of the container crane.

In another aspect of the invention a method for automatic calibration of a container crane is described, wherein said container crane is controlled by a system comprising at least a first sensor and/or a second sensor, and wherein by the actions of moving the crane to a position adjacent a fixed and known calibration device or rig, making an image of a plurality of markers using said at least one first sensor, and by calculating one or more position parameters for at least one control model for controlling the crane relative to a position of a load or a target landing/lifting position.

The primary advantage of the automatic calibration device is that calibration may be carried out automatically with minimum manual intervention. For a basic calibration only a crane operators actions are necessary, and no ground personnel. The automatic process is faster than the known manual methods and saves a lot of valuable time. The time spent calibrating manually has previously involved manpower costs as well as loss of production, estimated to take 4-8 hours per crane.

Previous manual methods also required, depending somewhat on how much time is available, an estimated 1-4 hours to be spent on stacking tests and parameter fine-tuning. The new calibration system takes around five to fifteen minutes depending on which processes are used to turn power to the LPS spreader markers on and off. In addition, the time-saving potential of the automatic calibration may be at least doubled when looking at the manpower costs for calibration because maintenance personnel are usually not allowed to work alone in a block of containers.

Another advantage is that the new automatic calibration gives a consistent accuracy throughout a given block of containers and is the same for all cranes in the block. It depends on the accuracy of the reference markers and is independent of human skill and experience. The new method requires no special skill or experience for performing the normal calibration. Extra manual work that may be needed during commissioning or equipment change is limited to being able to measure trim, list and skew and entering these results into the system, for the LPS.

In another embodiment of the invention a graphic user interface is disclosed which is used to carry out parts of the methods of the invention and which displays the measurements, parameters and validations of the calibrations so determined.

Another object of the present invention is to provide an improved computer program product and a computer readable medium having a program recorded thereon, for automatically calibrating a container crane, said container crane controlled by a control system comprising at least a first sensor (LPS) and/or a second sensor (TPS) to determine a position relative to a freight container handled by a crane.

BRIEF DESCRIPTION OF THE DRAWINGS

A more complete understanding of the method and system of the present invention may be had by reference to the following detailed description when taken in conjunction with the accompanying drawings wherein.

DETAILED DESCRIPTION OF THE INVENTION

Figure 1:
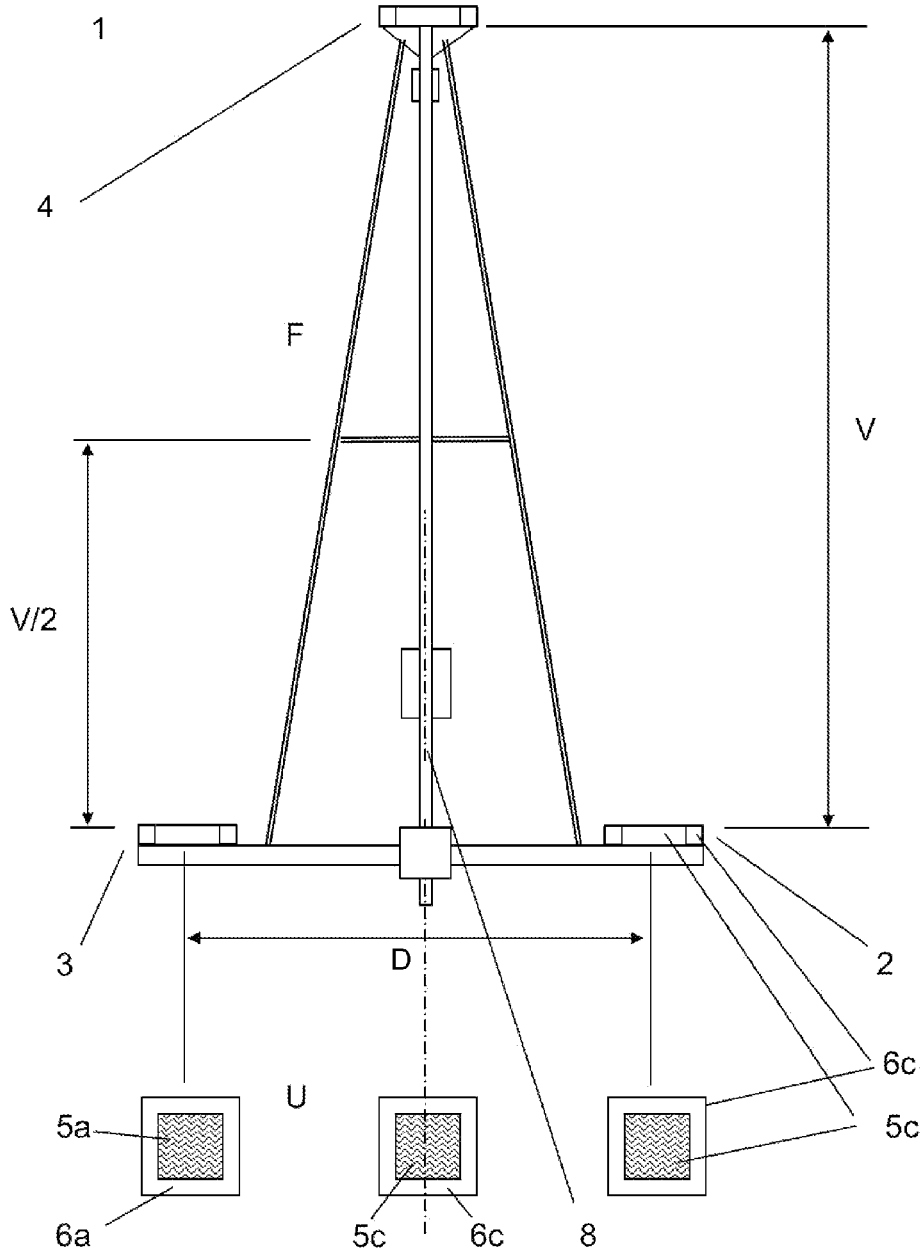
FIG. 1 shows in a simplified schematic diagram a calibration rig for a container crane according to an embodiment of a first aspect of the invention.

FIG. 1 shows a simplified diagram of a calibration rig 1 according to an embodiment of a first aspect of the present invention. The rig is shown as seen from a view F in front, and has markers mounted at three positions 2, 3, 4, which are accurately measured beforehand and the position of each marker is known. Each of the markers in the exemplary embodiment shown comprise a first marker with a first visual appearance, such as an active marker 5*a-c* which is preferably a light source, and a second marker comprising a second visual appearance which is preferably a passive marker 6*a-c*. Two marker positions 2, 3 are arranged substantially horizontally at a known and fixed distance D apart. The third position 4 is arranged substantially perpendicularly above the mid point of 2-3 at a substantially vertical distance V. A vertical check means 8 such as a simple plumb line, or a sensor that may be read remotely, may be mounted to provide a ready check that the rig is correctly aligned in the vertical direction. The markers are also shown in the lower part of the diagram in a view U as seen looking down from above the rig. The first or active markers 5*a-c* are indicated with a cross hatching and are arranged attached to the second or passive markers 6*a-c* shown as plain rectangular shapes defined by one or more straight edges in this embodiment.

At each marker position 2, 3, 4 a first or active marker 5*a-c* is arranged together with a second or passive marker 6*a-c*. The first or active markers may be a light source of some type, such as an IR (Infra Red) diode which is detected during a calibration process by an optical receiver or sensor such as a camera, CCD camera or video camera of the LPS (Load Position System). The passive markers 6*a-c* comprising a surface with the second visual appearance are detected by a laser scanner of the TPS (Target Position System) which surface and/or one or more edges of the passive markers. The passive marker may, for example, have a substantially rectangular or circular etc. planar shape. By this arrangement of combined targets, the first marker with a first visual appearance, an active marker, and the second marker with the second visual appearance, a passive marker, arranged or attached together, the two sensors of the two control system subsystems can register and be calibrated by both systems to the same position in space in the container yard.

Figure 2:
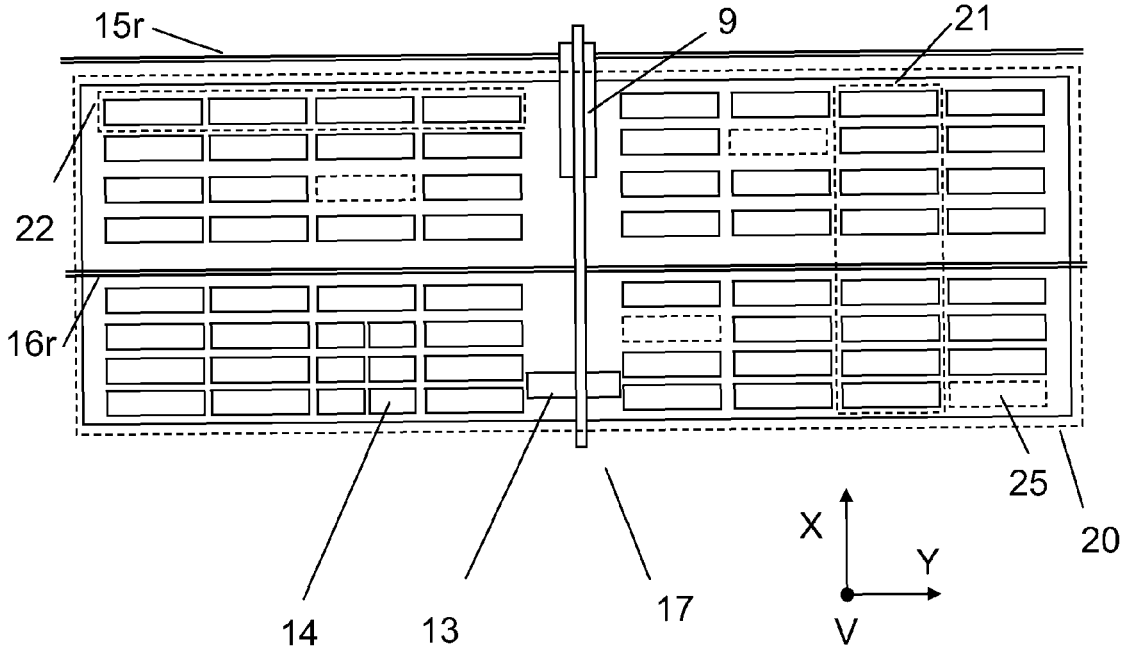
FIGS. 2 and 9 show simplified diagrams of a layout for container stacks and a container crane in a freight terminal or harbour.
Figure 9:
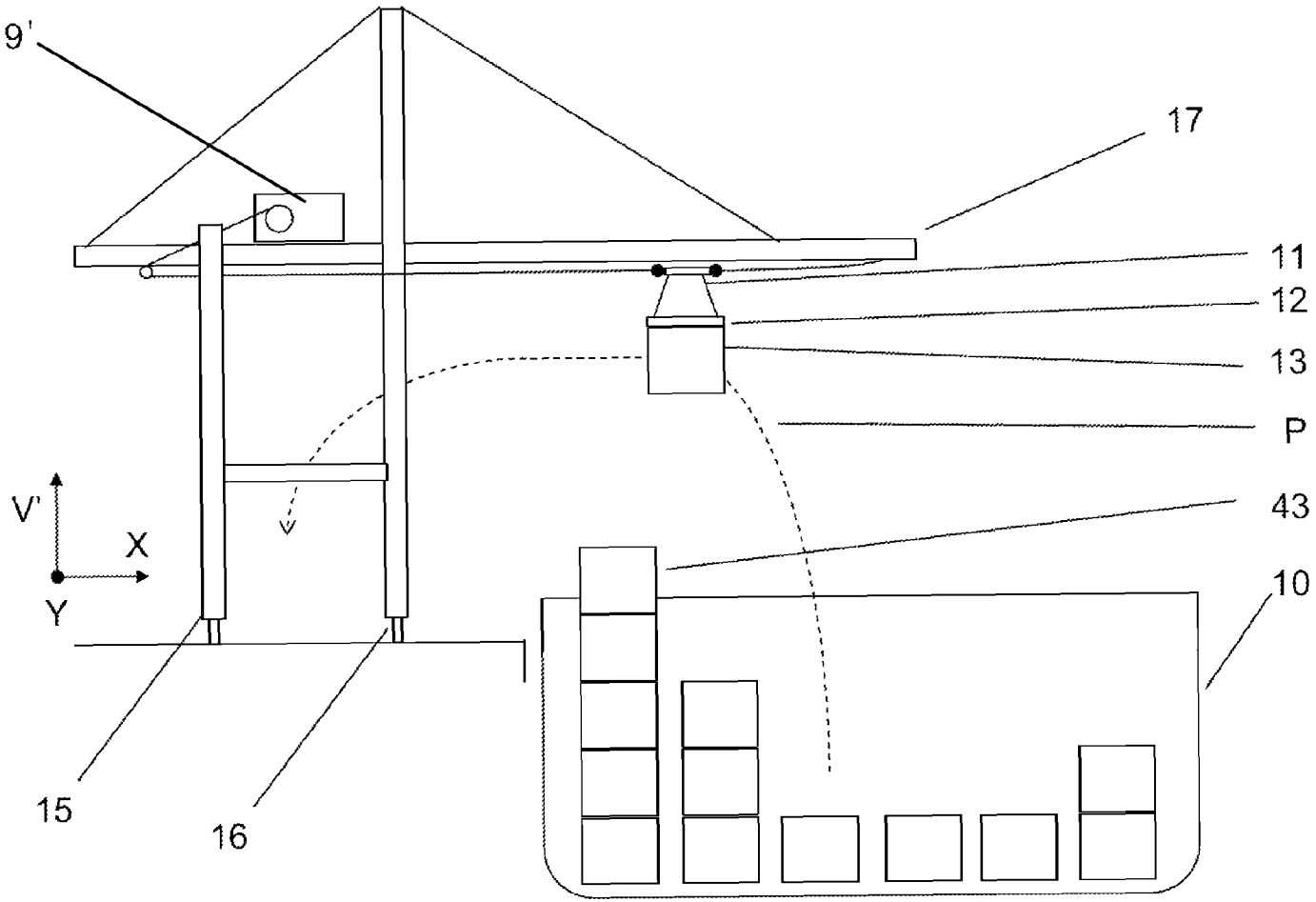

FIG. 9 shows a ship 10 and a STS crane 9'. The crane is shown to have a gantry 17 under which runs a trolley 11 forward and back in the X direction. This direction is also known as the gantry direction. The trolley supports a spreader 12 which holds a container 13. The crane lifts the container 13, for example, out of the ship 10 and along a path such as path P to be set down on a container, or a landing place such as a ground slot, or onto a truck or other vehicle (not shown). The crane 9' runs on rails under each set 15, 16 of legs in a direction in or out of the plane of the paper, indicated as a Y direction. This direction is also known as the trolley direction. FIG. 2 also shows a layout of containers, cranes and container stacks in a freight terminal or harbour in a view from above the freight yard. FIG. 2 shows a block of containers 20 and a container crane 9'. The gantry 17 of the crane is shown supporting a container 13 (see also the container, spreader and trolley in FIG. 9). The crane runs on two rails 15*r*, 16*r* in the Y or trolley direction. The rectangular block 20 of stacked containers and ground slots 25 is a known but arbitrarily selected group of container stacks around one crane and preferably between two cranes. In this description the group 20 is called a "block" of container stacks and ground slots. Containers may be full size such as 40 foot containers or other sizes such as 20 foot containers 14 arranged in ground slots. The block is also divided into single lines of containers or ground slots in the X direction called bays 21; and into single lines of containers along a direction perpendicular to that which are called rows 22.

Figure 3:
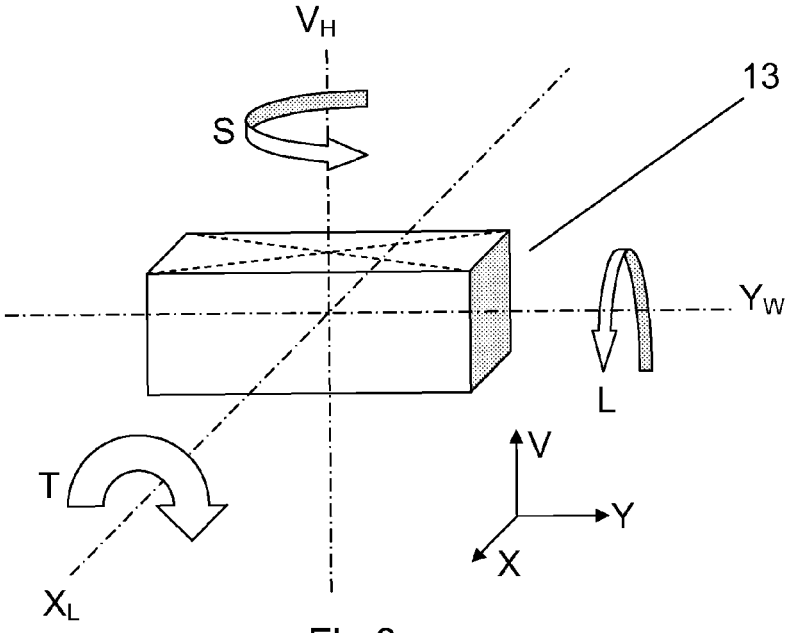
FIG. 3 shows a simplified diagram of a standard container illustrating axes and directions of movement.

FIG. 3 shows three principal orthogonal axes X, Y, V with respect to a container 13, and shows three imaginary centre lines for the container with respect to the orthogonal axes. The figure also shows diagrammatically a skew error S as a rotation about a vertical axis V, a list error L with which a container tends to list around its long axis and rotate about the axis Y, and a trim error T with which one of the ends of the container along the long axis hangs lower than the other end, shown as a rotation about the imaginary centre line axis X.

The calibration processes for TPS and LPS are both absolute (i.e. relative to the yard X-Y-V coordinate system) and thus there is no need for co-calibration between the LPS and the TPS. The result is a high and consistent accuracy throughout the container block 20. Since all cranes in a block are absolute calibrated using the same references their co-stacking capability is improved because any measurement error in the position of the reference targets will have the same effect on all cranes.

With the automatic calibration system there is no need of extensive, time-consuming stacking tests with tweaking or fine tuning of offsets and other adjustment parameters in order to get a satisfactory result.

The system is able to self-diagnose the status (i.e. quality) of its calibration parameter set, using the known positions of the reference targets. An adaptation algorithm is available for automatically adjusting parameters used by the positioning systems in order to handle the possible effect of changes in the environment, such as shifting of the rails etc. This is described in more detail below.

Automatic calibration of the LPS system is carried out using three LPS reference markers 5*a-c* at accurately determined positions 2,3,4 in the yard (see FIG. 1 for marker positions on the rig). A preferred setup of these markers is to use two lower markers 5*a*, 5*c* (at D=approximately 2 meters apart) arranged with a high marker 5*b* placed above and between the lower ones (at approximately 3.5 meters height V). The choice of detailed setup dimensions may be varied depending on practical issues and algorithm performance. During calibration it is desirable and may be necessary to be able to switch the power on/off to the first or active reference markers 5*a-c* and to the existing markers (used by the crane control system to register and calculate spreader position) mounted on the spreader 12, if necessary. Preferably this power on/off should be controllable automatically, from the crane or remotely.

The automatic calibration is enabled in part by a model-based LPS system. During production the model is able to determine very accurately the position of the spreader markers. These positions are then used to determine the position of the spreader and bottom of the load (the container 13) as well as the trim, list and skew.

Figure 6:
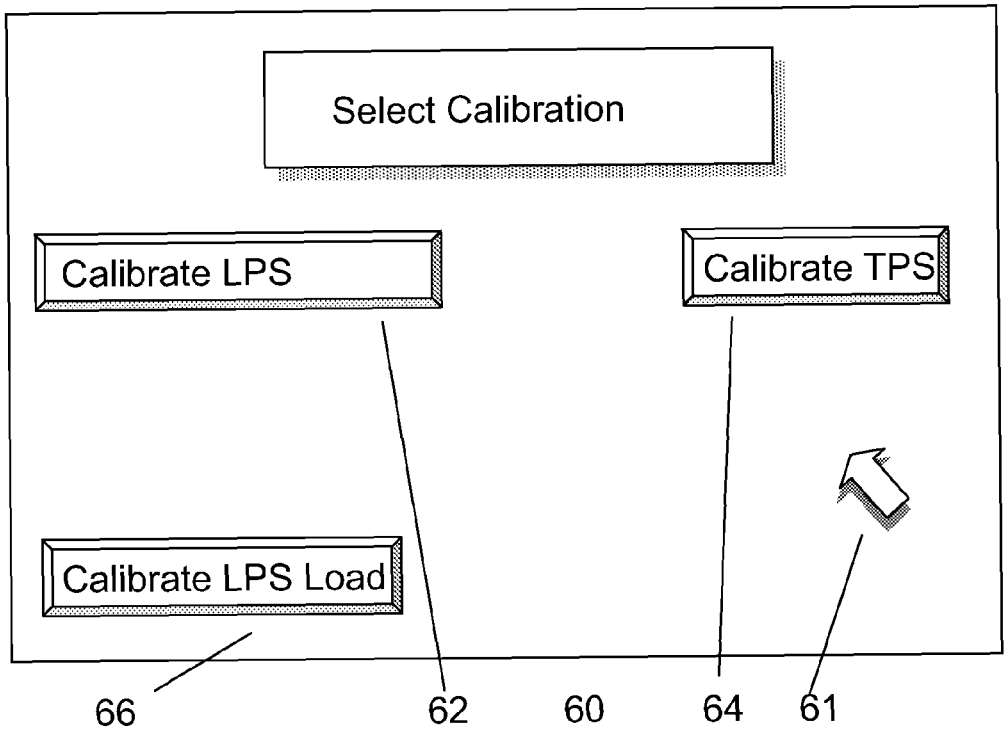
FIG. 6 shows schematically an interface for displayed for an operator to select an action of the automatic calibration process according to an embodiment of the invention.

The calibration procedure for the crane operator consists of pressing a "start calibration" button after which the crane moves into position at the reference marker rig, the spreader markers are switched off if necessary and the rig markers 5*a-c* switched on (see also Calibrate LPS button of FIG. 6). The LPS camera on the trolley then detects the rig markers, measurements are made by the camera, model parameters are calculated and the crane returns to the block after restoring power to the spreader markers and switching of the calibration rig markers.

On commissioning, or if any equipment (e.g. marker boxes, IR diode, spreader etc.) is changed, there is a need to establish or re-establish the relation between the spreader and its markers. This is done by lowering the spreader and measuring its trim, list and skew (see diagram of T,L,S in FIG. 3). These values are entered into the system where they are compared to the corresponding output from the LPS to create calibration variables compensating for any differences.

It is possible to let the crane return to the reference rig and have the LPS self-diagnose its calibration status. This is done by evaluating the positions of the reference markers which should equal the known, measured, positions of the reference markers.

The resulting accuracy of the calibrated model depends on the accuracy of the first or active marker 5*a-c* positions. An offset error in their position will lead to an offset error in the camera model and an error in the top marker 5*b* position will lead to a corresponding inclination error that is linear in height. However, all cranes using the same rig will get the same offsets. During operation the precision of the LPS system is determined by the model errors (which are likely to be very small) and the correctness of the inclination tables (described in more detail below) in addition to the always present, uncontrollable, random errors (such as wheel position on the rail etc.).

Figure 4:
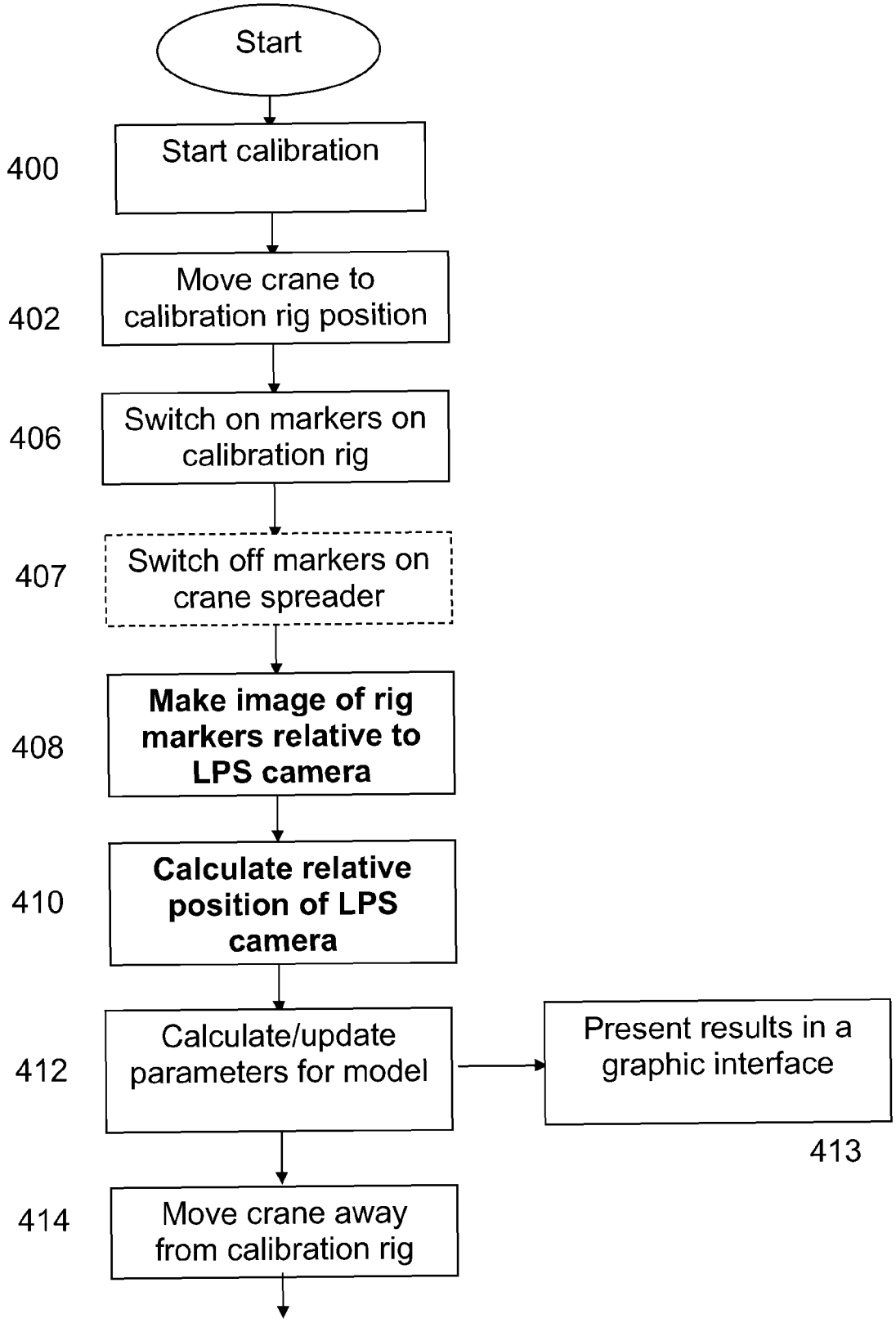
FIGS. 4 and 5 show flowcharts for a method of carrying out an automatic calibration of the container crane according to an embodiment of second aspect of the invention.

FIG. 4 shows a flowchart for a method of carrying out the automatic calibration on, for example, the LPS system, using the calibration rig 1. The figure shows the blocks:

400 start calibration, the operator press a start button (eg Calibrate LPS 62 FIG. 6)

Figure 8:
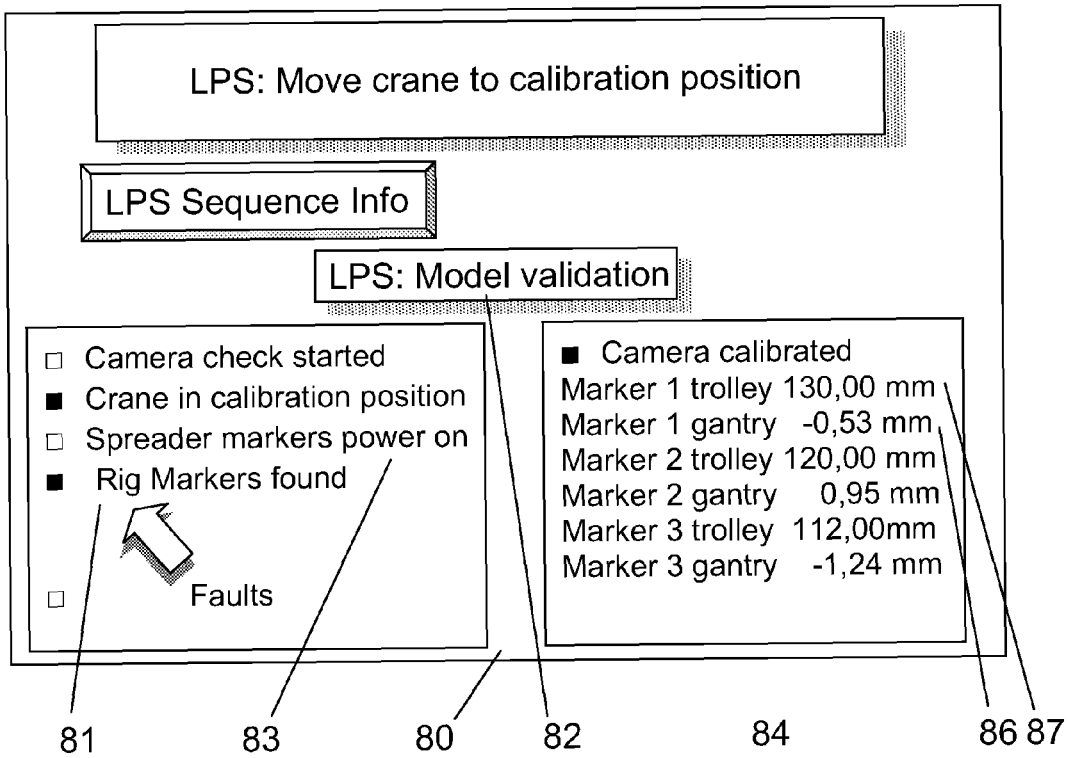

402 move crane to calibration rig position,—the crane is moved to be adjacent to the calibration rig, preferably automatically,

406 switch on markers on the rig, the active markers 5*a-c* are switched on,

407 the markers on the crane spreader are switched off, if that is necessary, so that the sensor system detects the calibration rig and is not affected by the spreader marker light sources,

408 make image of rig markers relative to the trolley with LPS camera, so that the positions of the active rig markers 5*a-c* are found and measured,

410 calculate relative position of rig markers to trolley, the measured positions of the rig markers extracted from the marker image data are compared to stored values for the marker positions,

412 calculate/update parameters for model, after comparison the model values may be updated from the measured values if the measured values are, upon checking, found to be valid,

413 Present results on a graphic interface 60, 70, 80; see for example items 86, 87 as shown in FIG. 8, which is then followed by the actions of moving crane away from calibration rig, and switching off the rig markers, and switching on the spreader markers (if the spreader markers had been switched off in 407).

The LPS calibration calculates the position of the spreader 12 and the actual position of the trolley 11 house (in both gantry and trolley directions). As noted previously, the TPS system is used to detect the position of a Target Landing Position (or lifting position) for a container 13, as well as to measure or map positions for other container stacks etc near to the position of interest. TPS calibration uses the position of the trolley 11 house together with the known positions 2,3,4 (shown in FIG. 1) of the calibration rig. The TPS measures the position of the rig markers in a similar way as described above and in relation to FIG. 4; and adjusts its calibration parameters until the TPS measured position of the rig corresponds to the actual position of calibration rig and trolley house position. When more than one crane are arranged together both cranes carry out calibrations using the same automatic calibration rig, which will ensure that both cranes will later measure the containers equally in the block. However the TPS system uses the passive markers 6*a-c* because it has a different sensor, preferably a laser scanner.

The TPS calibration is made in sequence with and following the LPS calibration. When pressing the "start calibration" button the control system will first make an LPS calibration (see FIG. 6). After an acknowledgement of a successful LPS calibration the control system then carries out the TPS calibration. The result is presented in the user interface (see partial displays in FIGS. 7-8). Some additional work is required on commissioning or if equipment is changed (i.e. leveling and skew determination of the TPS).

Figure 5:
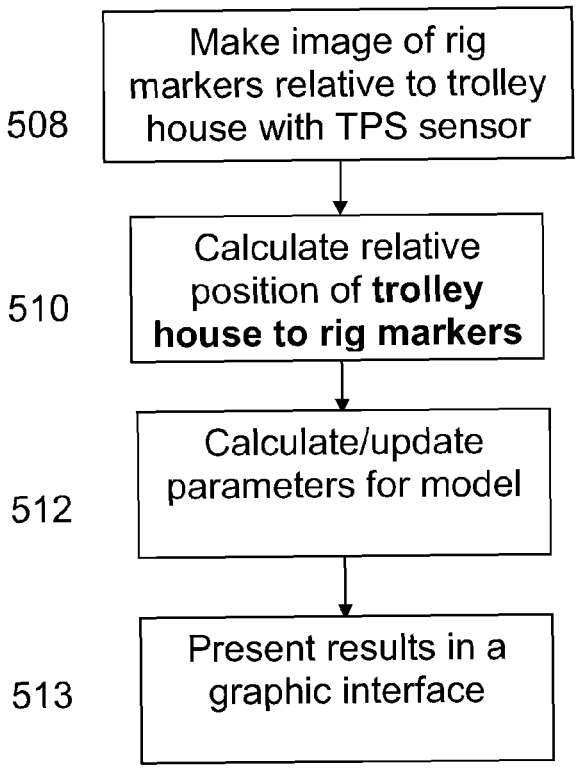

FIG. 5 shows a flowchart for a method of carrying out the automatic calibration on, for example, the TPS system, using the calibration rig 1. The figure shows in addition to the blocks 400-407 of the method of FIG. 4 the following blocks:

508 make image of rig markers relative to trolley house with TPS sensor; so that markers 6*a-c* are detected by trolley sensor or laser scanner,

510 calculate relative position of rig markers to trolley house; similar to 410 image data is processed to extract a position for markers 6*a-c*,

512 calculate/update parameters for model; the measured positions are validated and compared to stored values, and parameters updated where necessary,

513 Present results on a graphic interface, similar to the examples in FIG. 8.

Figure 7:
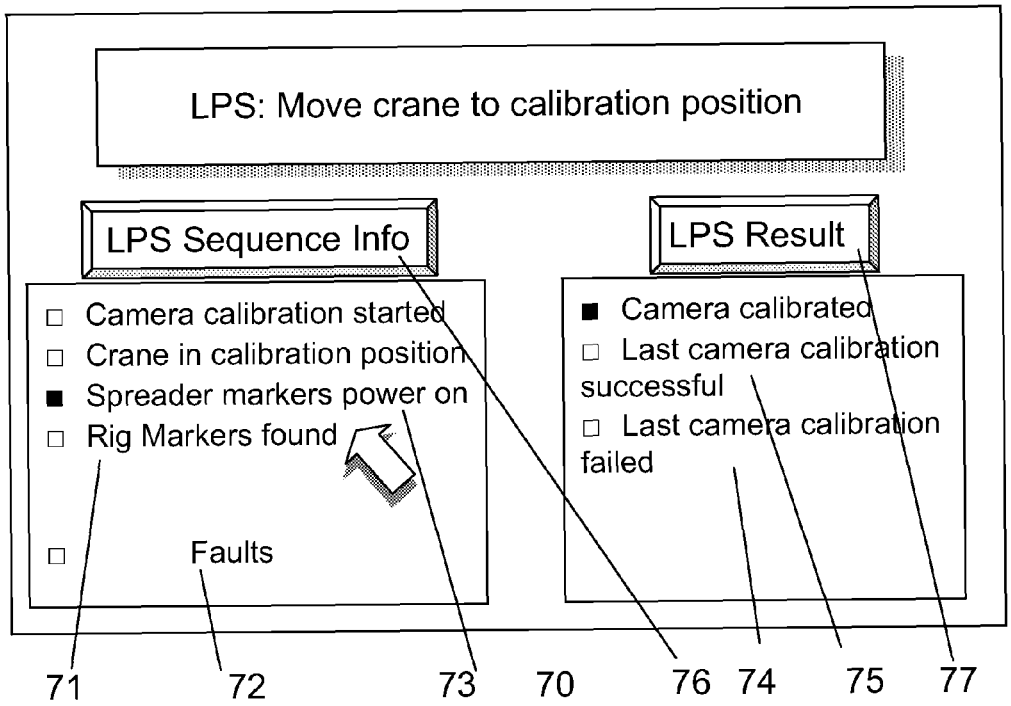
FIGS. 7-8 shows schematically one or more interfaces for displaying method steps and other information relevant to an embodiment of the invention.

A graphical user interface (GUI) may be used to display one or more of the information or values obtained using the system and methods described above. FIG. 6 shows schematically a simplified diagram for a GUI 60 which displays an interface comprising selection means for starting a calibration or automatic calibration of LPS, Calibrate LPS 62, to calibrate a container load, Calibrate Load 66, and to calibrate the TPS system, Calibrate TPS 64. FIG. 7 shows a GUI interface 70 displaying in a schematic way information displayed during the LPS calibration process. The figure shows information about stages in the process, LPS Sequence Info 76, which may comprise status indicators such as camera calibration started, crane in calibration position, spreader markers power on 73 (marked positive), rig markers found 71, and Faults. In the figure the process info shows that the spreader markers are still on. LPS Result 77 displays information such as camera calibrated (indicated as completed), last camera calibration successful 76, last camera calibration failed 74.

FIG. 8 shows a similar interface 80 displaying an LPS Model Validation 82 result. Among the information determined during the calibration and displayed on this type of interface are status indications for: camera check started, crane in calibration position (indicated as completed) spreader markers on 83, rig markers found 81 (indicated as completed). Thus an operator would understand that the crane has moved over to the rig 402 FIG. 4, the spreader markers are off 407, and that the rig markers are on 406 and detected. The figure also shows results from a calibration including comparable figures for measurements from the trolley (TPS system) 87 and measurements from the gantry 86.

As described above, a Load Position System (LPS) is preferably used to determine, from the trolley position and the spreader position, the instantaneous position of a container in space. However it is also possible to determine the position of the container under the spreader by means of external sensors. In addition, data from a LPS may also be supplemented by data from external sensors.

The measurement system of LPS and TPS may also comprise adaption methods and algorithms in order to minimize errors. A first way to minimize error is for a crane to always pick up a container at the same position as where another crane made the set-down; and in addition within the control system:

LPS system should report the same position as where TPS measured the container at a pickup of a container, and TPS system should measure the ground markers to be in nominal position. Ground markers are markers fixed on the ground which indicate the position of one or more ground slots.

Errors in measurement while handling containers may come from many possible sources:

a) Inclination in gantry rail
b) Curves in gantry rail causing skew in crane position
c) Wheel position on gantry rail causing offsets in trolley direction
d) Wheel position on gantry rail causing skew in crane position
e) Gantry positioning error (synchronization offset)
f) Twisted trolley girder profile causing error in measurement angle
g) Skew of trolley platform on trolley rail
h) LPS calibration error
i) TPS calibration error Some errors such as (i) TPS calibration error are constant through the block. Other errors such as gantry rail inclination and direction (a) depend on gantry position along the rail and are thus different from bay to bay. Error in gantry inclination also twists the trolley girder, which makes the error different from one lane to another. To take care of the different types of errors the adaptation is made individually for each ground slot but also common for actual bay, actual row and for the whole block, that is, there are four adaptions (for ground slot 25, bay 21, row 22 and block 20 FIG. 2).

There are errors that are stochastic such as wheel position on gantry rail. To reduce the impact of those errors on the adaptation only a small part of the measurement difference (about 5%) is used for adjustment of the system. How much is defined using weight factors, the weight factors are individual for slot, bay, row and block and also individual for the adaptation between cranes, between TPS and LPS and between TPS and ground measurements.

The adaption between LPS/TPS and between the cranes can not detect when inclination in gantry rail cause the stacks not to be erected vertically. The adaptation will make both cranes to stack in the same position but if one crane has a bad unknown inclination, both cranes will make a stack with half that error in inclination. Therefore there is still a need for measuring the inclination of the gantry rail. The inclination will be preset to zero in the position of the calibration rig. The inclination of all other positions will be determined relative to the inclination of this position, and the values stored in an inclination table.

The processing or supervision of the calibration methods may be carried out automatically by one or more or computerised processes without any need for supervision by or actions from an operator. At any time an operator or other authorised person may access the system to display, view, inspect or analyse live data on-line or off line as required.

In another embodiment the first markers have a first visual appearance but are not active markers in the sense of being illumination sources. The first markers may for example be highly reflective for the ambient natural light or for wavelengths associated with illumination by lamps on the spreader (or trolley) and/or wavelengths that are significant for the camera sensors. The second markers are passive markers that have different visual characteristics from the first markers. The surface may be non-reflective to particular wavelengths or highly reflective to selected, but in any case the visual and/or optical characteristics are different to those of the first markers. In its simplest form the first markers have a first visual appearance according to a first colour and the second markers have a second visual appearance according to a second colour. By means of the first and second visual appearance it is clear to the system which set of markers are being detected, registered and/or photographed.

Methods of the invention may be supervised, controlled or carried out by one or more computer programs. One or more microprocessors (or processors or computers) comprise a central processing unit CPU connected to or comprised in one or more of the above described crane control units, which processors, PLCs or computers perform the steps of the methods according to one or more aspects of the invention, as described for example for operating or controlling a system of two industrial handlers and two presses, as described with reference to FIG. 4. It is to be understood that the computer programs for carrying out methods according to the invention may also be run on one or more general purpose industrial microprocessors or PLCs or computers instead of one or more specially adapted computers or processors.

The computer program comprises computer program code elements or software code portions that make the computer or processor perform the methods using equations, algorithms, data, stored values, calculations, synchronisations and the like for the methods previously described, and for example in relation to the flowcharts of FIGS. 4, 5, and/or to the graphic user interfaces of FIGS. 6, 7, 8. A part of the program may be stored in a processor as above, but also in a ROM, RAM, PROM, EPROM or EEPROM chip or similar memory means. The or some of the programs in part or in whole may also be stored locally (or centrally) on, or in, other suitable computer readable medium such as a magnetic disk, CD-ROM or DVD disk, hard disk, magneto-optical memory storage means, in volatile memory, in flash memory, as firmware, or stored on a data server. Other known and suitable media, including removable memory media such as Sony memory stick™, a USB memory stick and other removable flash memories, hard drives etc. may also be used. The program may also in part be supplied or updated from a data network, including a public network such as the Internet.

It should be noted that while the above describes exemplifying embodiments of the invention, there are several variations and modifications which may be made to the disclosed solution without departing from the scope of the present invention as defined in the appended claims.

What is claimed is:

1. A calibration device for automatic calibration of a container crane, said container crane being controlled by a system comprising at least one of a first sensor and a second sensor, characterised by a calibration rig arranged in a fixed position and comprising a plurality of markers, each arranged at a known and fixed position and distance relative to one another.

2. The device according to claim 1, characterised in that the calibration rig is arranged in a fixed position in a container yard, freight yard or harbour.

3. The device according to claim 1, characterised in that the calibration rig is arranged with at least two first markers comprising a surface with a first visual appearance.

4. The device according to claim 3, characterised in that the calibration rig is arranged with at least two second markers comprising a surface with a second visual appearance.

5. The device according to claim 4, characterised in that two first or active markers) comprise an illumination source from any of the group of: IR laser, IR lamp, visible spectra lamp.

6. The device according to claim 1, characterised in that the plurality of markers are arranged such that at least two first or active markers are arranged in the same known and substantially horizontal plane and separated by a known distance.

7. The device according to claim 1, characterised in that the plurality of markers are arranged such that at least two first or active markers are arranged in the same known and substantially vertical plane and separated by a known distance.

8. The device according to claim 1, characterised in that at least two first or active markers are arranged in the same known and substantially horizontal plane and separated by a known distance and a third first or active marker is arranged substantially vertically above the first two active markers and separated by a known distance.

9. The device according to claim 1, characterised in that said at least first sensor is part of a load position system and said second sensor is part of a target position system.

10. A method for automatic calibration of a container crane, said container crane being controlled by a system comprising at least one of a first sensor and a second sensor, characterised by moving the crane to a position adjacent a fixed and known calibration device, making an image of a plurality of markers using said at least one first sensor, and calculating one or more position parameters for at least one control model for controlling the crane relative to a position of a load or a target landing/lifting position.

11. The method according to claim 10, characterised by making an image of at least two first or active markers comprised in said plurality of markers arranged on a calibration rig.

12. The method according to claim 10, characterised by calculating positions of a load position system camera from the image of at least two first or active markers relative to a spreader position.

13. The method according to claim 12, characterised by making one or more images of target position passive markers using a distance measuring means or a laser scanner.

14. The method according to claim 12, characterised by calculating positions of a trolley house relative to second or passive markers.

15. The method according to claim 12, characterised by applying an adaptation algorithm to a load position system calibration in respect of an error.

16. The method according to claim 10, characterised by making an image of at least two second markers with a second visual appearance, or passive markers comprised in said plurality of markers using the second sensor.

17. A container crane control system comprising at least one container crane, said system comprising at least one of a first sensor and a second sensor arranged on said crane, characterised by at least one calibration rig arranged in a fixed position relative the crane and comprising a plurality of markers, each arranged at a known and fixed position and distance relative to one another.

18. The container crane control system according to claim 17, characterised by a memory storage means comprising a computer program for automatic calibration of the container crane, said container crane being controlled by a system comprising at least a first sensor and a second sensor, said computer program comprising at least one of computer code and computer software means which, when fed into a computer or processor, will make the processor or computer carry out a method for automatic calibration of the container crane.

* * * * *